US006803714B2

(12) United States Patent
Hwang

(10) Patent No.: US 6,803,714 B2
(45) Date of Patent: Oct. 12, 2004

(54) MASK ASSEMBLY FOR COLOR CATHODE RAY TUBE

(75) Inventor: In Hyuk Hwang, Gyeongsangbuk-do (KR)

(73) Assignee: LG Philips Displays Korea Co., Ltd., Gyeongsangbuk-do (KR)

( * ) Notice: Subject to any disclaimer, the term of this patent is extended or adjusted under 35 U.S.C. 154(b) by 46 days.

(21) Appl. No.: 10/158,012

(22) Filed: May 31, 2002

(65) Prior Publication Data

US 2002/0180328 A1 Dec. 5, 2002

(30) Foreign Application Priority Data

May 31, 2001 (KR) ..... 2001-30602

(51) Int. Cl.[7] ..... H01J 29/80
(52) U.S. Cl. ..... 313/403; 313/402
(58) Field of Search ..... 313/402–408

(56) References Cited

U.S. PATENT DOCUMENTS 3,585,431 A * 6/1971 Long ..... 313/407
4,495,437 A * 1/1985 Kume et al. ..... 313/403
4,672,260 A * 6/1987 Prazak, III ..... 313/407
4,827,180 A * 5/1989 Sone et al. ..... 313/404
5,041,756 A * 8/1991 Fairbanks ..... 313/407
5,532,545 A * 7/1996 Okamoto et al. ..... 313/407
5,592,044 A * 1/1997 Ohtake et al. ..... 313/403
5,610,473 A * 3/1997 Yokota et al. ..... 313/402
5,880,555 A 3/1999 Park ..... 313/402
6,552,481 B2 * 4/2003 Furusawa et al. ..... 313/407

* cited by examiner

*Primary Examiner*—Nimeshkumard D. Patel
*Assistant Examiner*—Peter Macchiarolo
(74) *Attorney, Agent, or Firm*—Birch, Stewart, Kolasch & Birch LLP

(57) ABSTRACT

A mask assembly for a color cathode ray tube, has an amount of tension applied to a shadow mask thereof reduced by preventing a main frame for applying tension in the shadow mask from deformation due to creeping during a high temperature process, by regulating the ratios of thickness, width, and height of the main frame to the thickness of the shadow mask. The color cathode ray tube comprises a frame composed of a main frame welded to the shadow mask for supporting the shadow mask toward the panel and a sub-frame supporting said main frame, wherein relations $T/t \geqq 45$, $W/t \geqq 270$, and $H/t \geqq 270$ are satisfied, where t is a thickness of the shadow mask, T is the thickness of part where a main frame is welded to a shadow mask, W is a width of part attached to a sub-frame of a frame, and H is a length of main frame from said shadow mask to the sub-frame.

6 Claims, 9 Drawing Sheets

MASK ASSEMBLY FOR COLOR CATHODE RAY TUBE

BACKGROUND OF THE INVENTION

1. Field of the Invention

The present invention relates to a mask assembly for color cathode ray tube (CRT). More particularly, the present invention is directed to a mask assembly for a color cathode ray tube, wherein an amount of tension applied to a shadow mask is reduced by preventing a main frame for applying tension in the shadow mask from deformation due to creeping during a high temperature process. An amount of tension is reduced by regulating the ratios of thickness, width, and height of the main frame to the thickness of shadow mask.

2. Description of the Related Art

FIG. 1 depicts a partial cross-section of structure of general color cathode ray tube (CRT). With reference to FIG. 1, the color CRT is a primary constitutional part by which an image is displayed in an image display apparatus such as a television monitor or a computer monitor. This CRT is composed of a panel 1 disposed at a front direction, and a funnel 2 disposed at the rear of the panel 1.

Also, within an inner space defined by said panel 1 and funnel 2, the CRT further comprises a fluorescent surface 4 emitting a fluorescence light, an electron gun embedded in a neck part of said funnel 2 for producing an electron beam 6 impinging on said fluorescent surface 4, a shadow mask 3 for discriminating a color which the fluorescent surface 4 finally fluoresces to create, a frame composed of a main frame 7 applying tension to the shadow mask 3 and a sub-frame 15 supporting said main frame 7, a spring 9 disposed at the side of said main frame for coupling said frame to said panel 1, an inner shield 8 fixed by welding to said sub-frame 15 for shielding an external earth magnetic field, and a reinforcing band 12 disposed at the side peripheral of said panel 1 for withstanding external impacts.

Also, the CRT further comprises a deflection yoke 5 for deflecting the electron beam 6 discharged at the electron gun (not shown) to upward or downward and left or right, and 2,4,6 pole magnets 11 for directing a trajectory of the beam into certain fluorescence materials, thereby preventing a deterioration of color purity.

The operational principle of the color cathode ray tube depicted in FIG. 1 is described below. The electron beam 6 discharged at the electron gun embedded in the neck of panel 2 strikes the fluorescent surface 4 formed in the inner side of panel 1 by the anode voltage applied to the cathode ray tube. This electron beam is deflected by the deflection yoke 5 upward or downward and also right or left prior to arriving to the fluorescent surface 4, thereby forming a pixel.

This cathode ray tube is in a high vacuum state so that a firecracker phenomenon can occur easily in the event of an external impact. Therefore, panel 1 is designed to have a structure strength that can withstand atmospheric pressure so as to prevent this phenomena.

Also, impact-resistance capability is guaranteed in such a way that stress experienced by a cathode ray tube in the high vacuum state is distributed with the reinforcing band 12 mounted at the outer surface of the skirt of panel 1.

The shadow mask 3 and main frame 7 are made to be in an equilibrium state by deformation when the main frame 7 for applying a tension to the shadow mask is welded.

In this case, a stress which is applied to the main frame 7 for applying tension to the shadow mask 3 should be lower than a material's breakdown strength so that a problem related to rigidity does not arise.

Meanwhile, if the stress applied to said main frame 7 is lower than a material's breakdown strength, no problem is arises with respect to rigidity, but a problem of a tension reduction phenomena in the shadow mask occurs by deformation created by creeping during a high temperature thermal process.

SUMMARY OF THE INVENTION

Accordingly, the present invention has an objective of providing a mask assembly of a cathode ray tube which prevents the reduction of tension in the shadow mask produced by the deformation of the main frame due to creeping during a high temperature thermal process, with the ratios of thickness, width and height of the main frame to the thickness of shadow mask regulated.

In a preferred embodiment for achieving an objective of the present invention, a relation of $T/t \geqq 45$ is satisfied, where the thickness of shadow mask is t and the thickness of a part where a main frame is welded to a shadow mask is T, for a cathode ray tube comprising a panel having a fluorescent surface disposed at an inner side thereof, a funnel adhered to a rear side of said panel, wherein adhesion is enabled by frit glass, a shadow mask coupled to the inner side of said panel, wherein a plurality of electron through-holes perform color discrimination for an electron beam, and a frame composed of a main frame welded to the shadow mask for supporting said shadow mask toward the panel and a sub-frame supporting said main frame.

In another preferred embodiment of the present invention a relation of $W/t \geqq 270$ is satisfied, where a thickness of a shadow mask is t and a width of a part attached to a sub-frame of a frame is W, for a cathode ray tube comprising a panel having a fluorescent surface is disposed at an inner side thereof, a funnel adhered to a rear side of said panel wherein adhesion is enabled by frit glass, the shadow mask coupled to the inner side of said panel, wherein a plurality of electron through-holes perform color discrimination for an electron beam, and a frame composed of a main frame welded to the shadow mask for supporting said shadow mask to the panel and the sub-frame supporting said main frame.

In another preferred embodiment of the present invention a relation of $H/t \geqq 270$ is satisfied, where a thickness of shadow mask is t and a length of a main frame from said shadow mask to a sub-frame is H, for a cathode ray tube comprising a panel having a fluorescent surface disposed at an inner side thereof, a funnel adhered to a rear side of said panel wherein adhesion to said panel is enabled by frit glass, the shadow mask coupled to the inner side of said panel, wherein a plurality of electron through-holes perform color discrimination for an electron beam, and a frame composed of a main frame welded to the shadow mask for supporting said shadow mask to the panel and the sub-frame supporting said main frame.

In another preferred embodiment of the present invention the main frame to which said shadow mask is welded is below 72% of a high temperature breakdown strength and also below 65% of a room temperature breakdown strength, for a cathode ray tube comprising a panel having a fluorescent surface disposed at an inner side thereof, a funnel adhered to the rear side of said panel wherein adhesion to said panel is enabled by frit glass, the shadow mask coupled to the inner side of said panel, wherein a plurality of electron through-holes perform color discrimination for an electron beam, and a frame composed of a main frame welded to the shadow mask for supporting said shadow mask to the panel and the sub-frame supporting said main frame.

BRIEF DESCRIPTION OF DRAWINGS

The above and other objects, features and other advantages of the present invention will be more clearly understood from the following detailed description taken in conjunction with the accompanying drawings, in which.

DESCRIPTION OF PREFERRED EMBODIMENTS

Hereinafter, preferred embodiments of the present invention for achieving the stated objectives will be described in detail with respect to the accompanied drawings.

Figure 1:
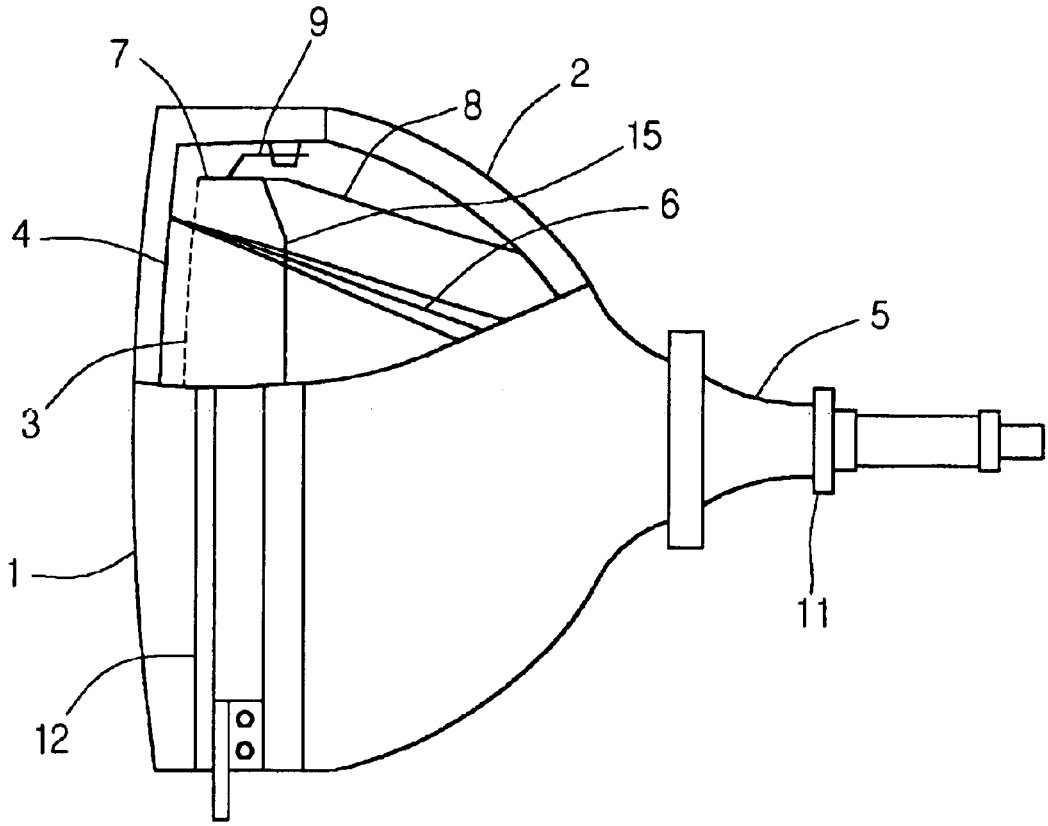
Fig. 1 BACKGROUND ART
FIG. 1 is a partial cross-sectional view illustrating a construction of general color cathode ray tube.
Figure 2A:
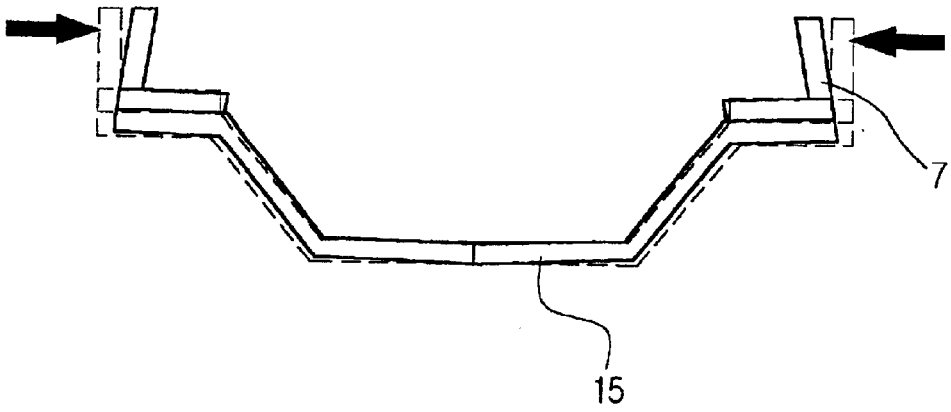
FIG. 2*a* illustrates a pressing process of a main frame.
Figure 2B:
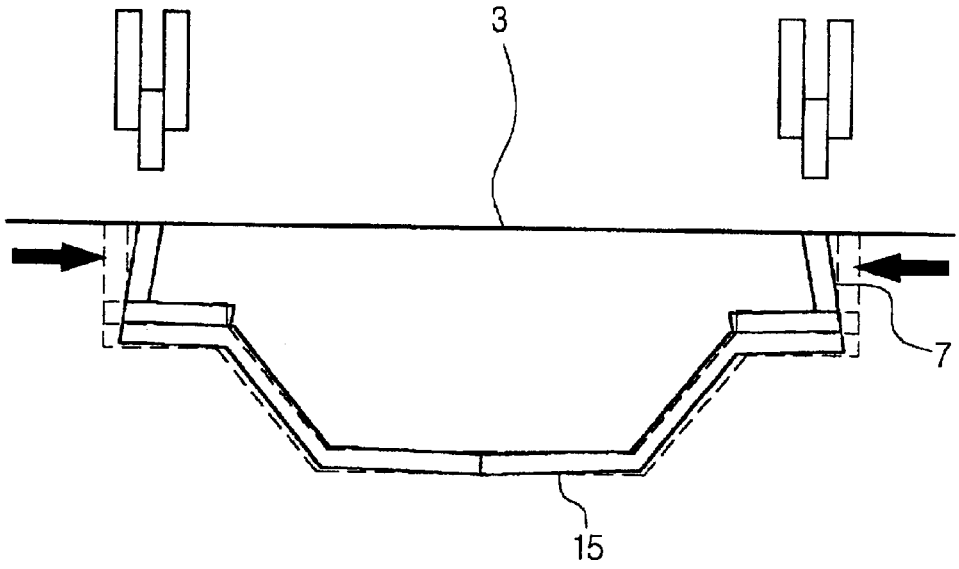
FIG. 2*b* illustrates the state in which a shadow mask is welded to the main frame after the pressing process of the main frame.
Figure 2C:
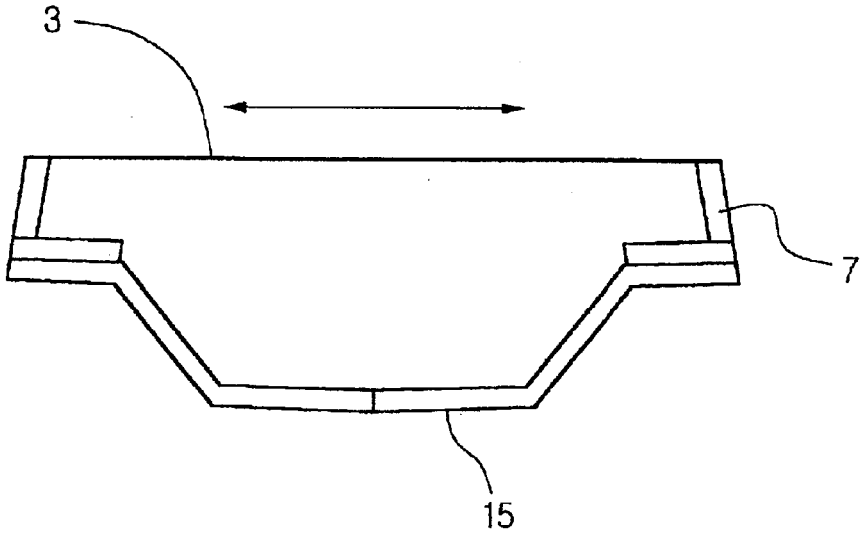
FIG. 2*c* illustrates the state in which the shadow mask and main frame are in equilibrium after pressing load to the main frame is eliminated.

FIG. 2*a* through FIG. 2*c* depicts the process of shadow mask 3 being disposed to the main frame 7.

FIG. 2*a* illustrates a pressing process of main frame 7 such that the curvature of shadow mask 3 is maintained in a designed dimension, FIG. 2*b* illustrates the state in which the shadow mask 3 is welded to the main frame 7, and FIG. 2*c* illustrates the state in which the shadow mask 3 and main frame 7 are in equilibrium after a pressing load to the main frame is eliminated.

Particularly, with reference to FIG. 2*c*, the above equilibrium state has such a disposition as the main frame 7 creates tension to the shadow mask 3.

Figure 3:
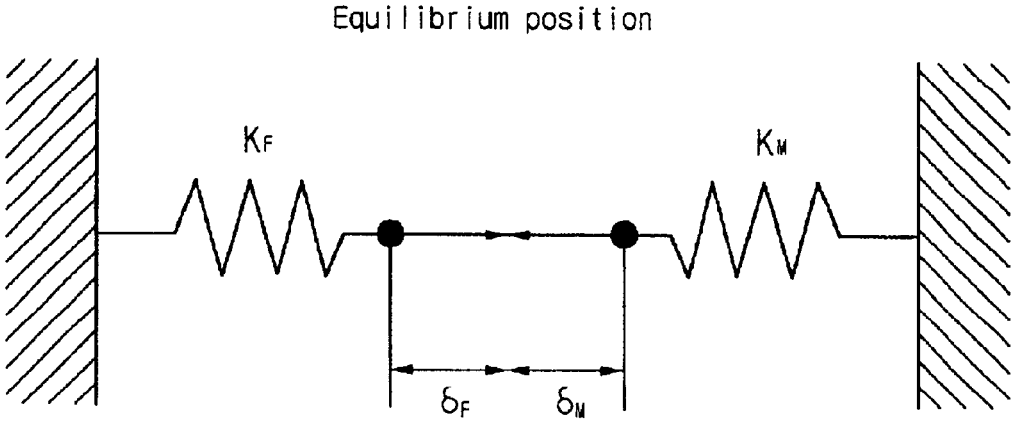
FIG. 3 is an equivalent model of FIG. 2*c*, illustrating the state in which tension is applied to the shadow mask by the main frame.

FIG. 3 depicts an equivalent model of FIG. 2*c*, illustrating the state in which the main frame 7 produces tension to the shadow mask 3.

With reference to FIG. 3, the main frame 7 and shadow mask 3 acquires the equilibrium state by shadow mask deformation $\delta_M$ and deformation of the main frame $\delta_F$.

Here, the equilibrium equation is described as follows when the main frame is pressed, the mask is welded, and load to the main frame is eliminated.

$$T=K_M\times\delta_M=K_F\times\delta_F,$$

where T represents tension applied to the shadow mask 3, $K_M$ represents the rigidity of the shadow mask 3, $K_F$ represents the rigidity of the main frame, $\delta_M$ represents the deformation of the shadow mask 3, and $\delta_F$ represents the deformation of the main frame 7.

Therefore, tension being applied to the shadow mask 3 is determined by the deformation of the shadow mask. The greater the deformation of shadow mask, the greater the tension being applied to the shadow mask 3, whereas the smaller the deformation of shadow mask, the more the tension applied to the shadow mask 3 is reduced.

That is, tension applied to the shadow mask 3 is reduced by an amount as much as the deformation of the shadow mask 3 is reduced because a force pulling the shadow mask 3 decreases according to the decline in rigidity of the main frame 7 due to the deformation by creeping produced during a high temperature thermal process. As a result, tension being applied to the shadow mask 3 is determined by rigidities of the shadow mask and the main frame.

Figure 4:
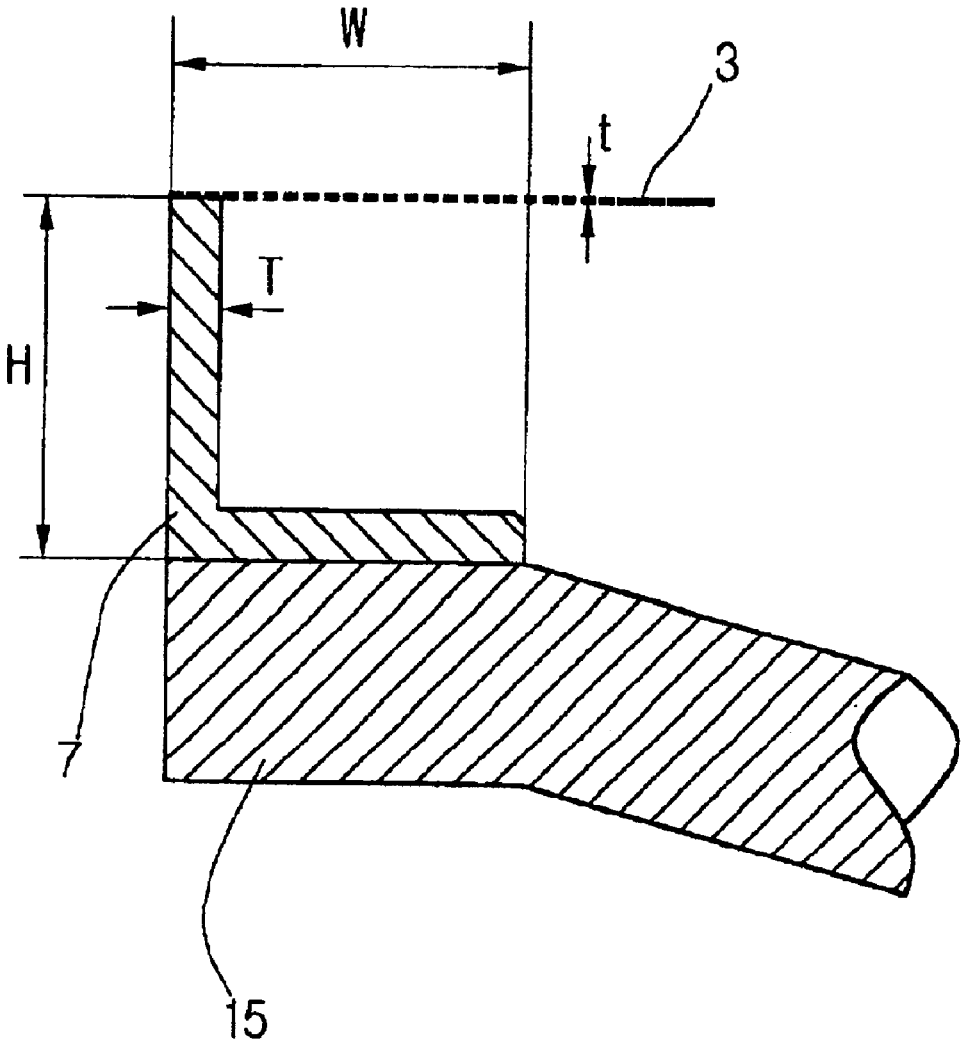
FIG. 4 is a cross-sectional view of the structure of which shadow mask is welded to the main frame.

FIG. 4 is a cross-sectional view illustrating the state of shadow mask 3 being welded to the main frame 7, where a thickness t of the shadow mask, and a thickness T, width W, height H of the main frame are depicted.

Here, the rigidity of said shadow mask 3 is related to thickness of the shadow mask, and the rigidity of said main frame 7 is related to thickness, width, height of the main frame.

As a result, tension applied to the shadow mask 3 is determined by thickness of the shadow mask 3, and a thickness, width and height of the main frame 7.

Figure 5:
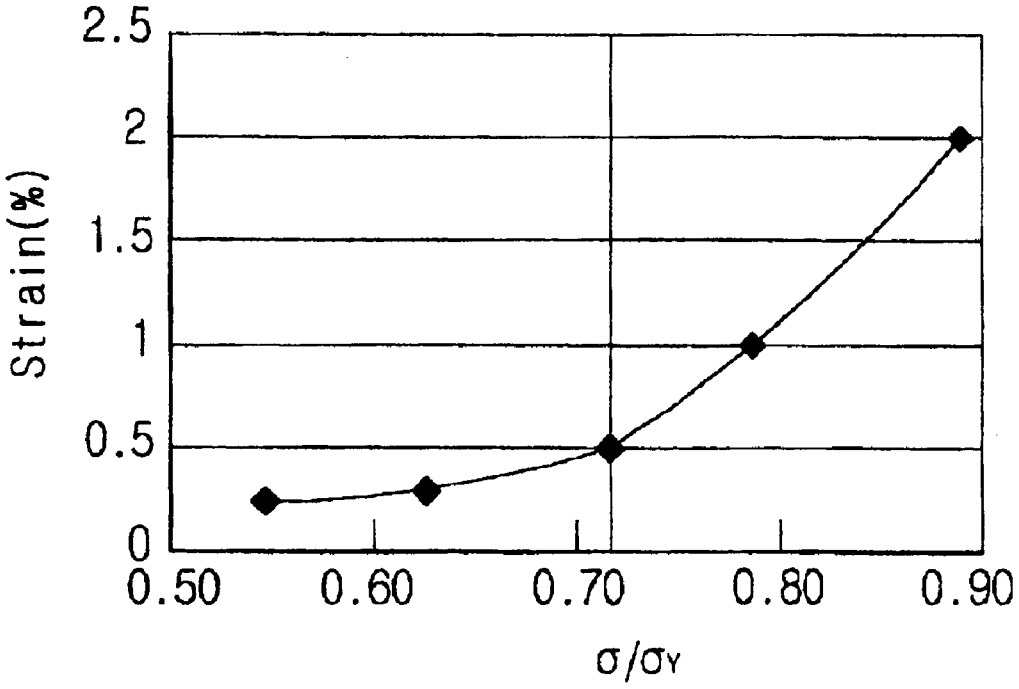
FIG. 5 represents the result of a creeping test (at condition 440°, 160 minutes) with regard to stress of the main frame.

FIG. 5 is a graph showing the result of a creeping test (440°, 160 min) with regard to the main frame stress.

Here, $\sigma_Y$ represents surrender rigidity, $\sigma$ represents current tension, $\sigma/\sigma_Y$ is a ratio of the current tension to the surrender rigidity, and a strain (%) represents a deformation amount from creeping.

With reference to FIG. 5, deformation of the main frame 7 is not great under tension below 72%, but the deformation by creeping is greatly increased with tension above 72% .

Figure 6:
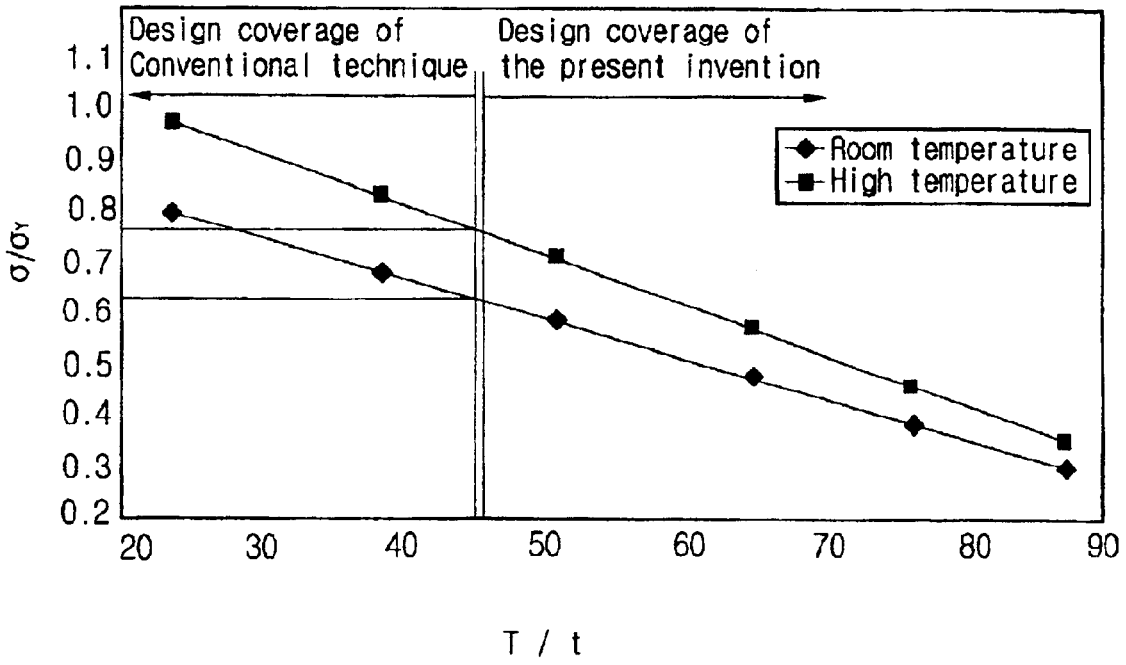
FIG. 6 illustrates the relation between the main frame stress and ratio of the main frame thickness to the thickness of the shadow mask, both for a conventional technique and for the present invention.

FIG. 6 is a graph illustrating the comparison result between a conventional technique and the present invention with respect to the relation between ratio T/t of shadow mask thickness t to the main frame thickness T and tension of main frame $\sigma/\sigma_Y$.

With reference to FIG. 6, the thickness ratio of main frame to shadow mask is conventionally below 45. In this case, conventional tension being applied to the main frame 7 is in the neighborhood of 62% compared to the breakdown strength under room temperature, and 76% compared to breakdown strength in high temperature.

However, the present invention reduces the deformation by creeping in such a way that the stress due to deformation is made to be below 72% by adjusting the ratio of main frame thickness to the shadow mask thickness to a value above 45.

Figure 7:
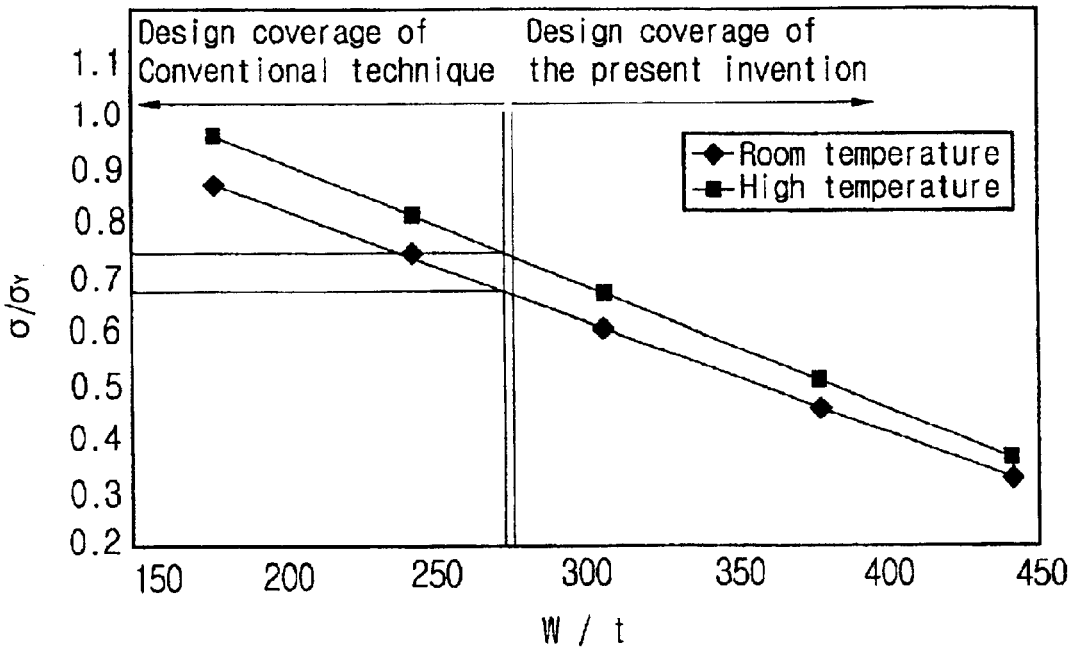
FIG. 7 illustrates the relation between the main frame stress and ratio of the main frame width to the thickness of the shadow mask, both for a conventional technique and for the present invention.

FIG. 7 is a graph illustrating the comparison result between the present invention and a conventional technique with respect to the relation between ratio W/t (main frame width W to the shadow mask thickness t) and tension applied to the main frame 7 $\sigma/\sigma_Y$.

With reference to FIG. 7, the ratio of main frame width to shadow mask thickness is conventionally below 270, where tension applied to main frame 7 is in the neighborhood of 65% compared to the breakdown strength in room temperature, and 72% compared to breakdown strength in high temperature.

However, the present invention reduces the deformation by creeping in such a way that tension by deformation is made to be below 72% by adjusting a ratio of the main frame width to the shadow mask thickness to a value above 270.

Figure 8:
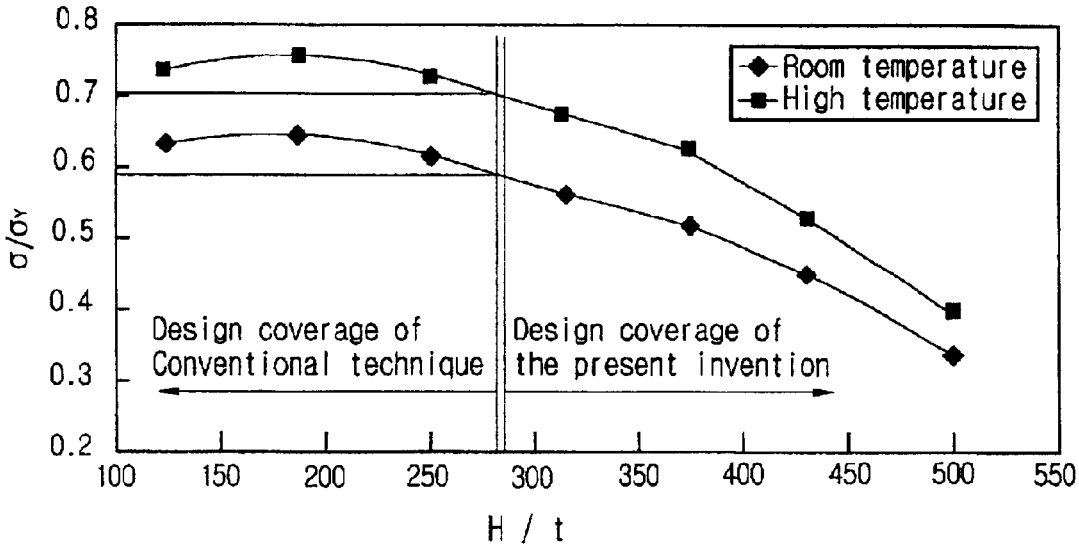
FIG. 8 illustrates the relation between the main frame stress and ratio of the main frame width to the thickness of the shadow mask, both for a conventional technique and for the present invention.

FIG. 8 is a graph illustrating the comparison result between the present invention and a conventional technique with respect to the relation between ratio H/t (main frame height H to the shadow mask thickness t) and tension applied to the main frame $\sigma/\sigma_Y$.

With reference to FIG. 8, a ratio of the main frame width to the shadow mask thickness is below 270 conventionally, where tension applied to the main frame 7 is in the neighborhood of 58% compared to the breakdown strength in room temperature, and 72% compared to breakdown strength in high temperature.

However, the present invention reduces the deformation by creeping in such a way that tension by deformation is made to be below 72% by adjusting the ratio of the main frame width to the shadow mask thickness to a value above 270.

Therefore, tension is above the level of 72% in the conventional technique, in which case deformation by creeping in the main frame 7 increases significantly as depicted in FIG. 5. In this case, a problem does not arise with respect to breakdown strength in room temperature, but deformation by creeping increases with respect to breakdown strength in high temperature.

However, the deformation by creeping is reduced even with respect to breakdown strength in high temperature when tension is applied below 72% according to the present invention.

Figure 9:
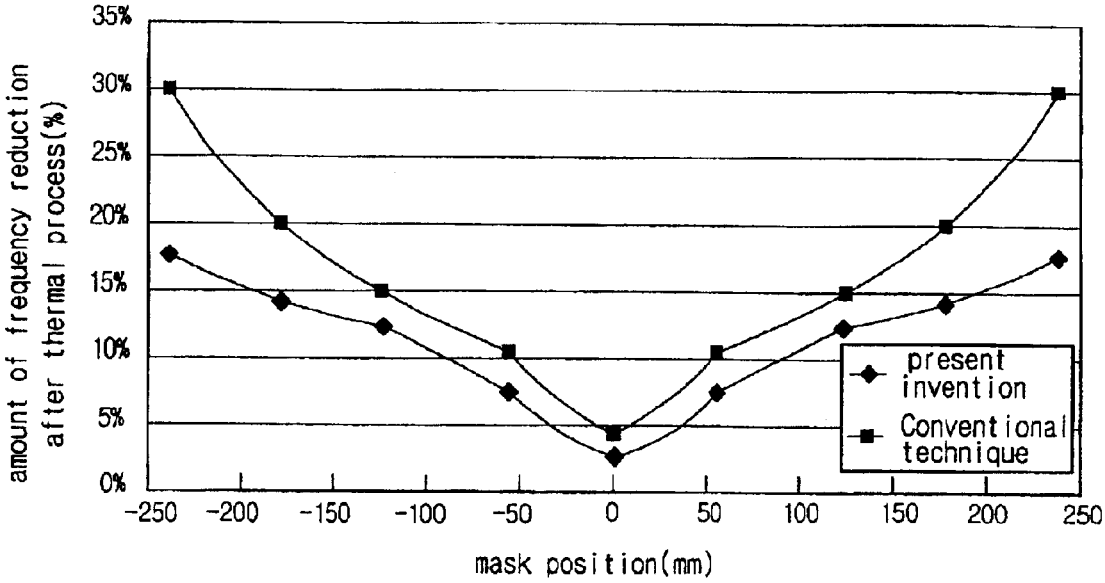
FIG. 9 illustrates the reduction amount of reduction in frequency after thermal processing relative to each position of the shadow mask, both for a conventional technique and the present invention.

FIG. 9 is a graph illustrating the comparison result between the present invention and a conventional technique for an amount of frequency reduction after a thermal process relative to each position of the shadow mask for measuring tension of the shadow mask.

The frequency is determined largely depending on a force applied to a one-dimensional axis because the mask experiences tension nearly along a one-dimensional axis in spite of not being a string. Therefore, a relationship applied to a string between frequency and tension can be applied to the shadow mask in the same manner.

The relationship between frequency and tension is described below.

$$f=1/(2L)\sqrt{(T/\rho)}.$$

Here, f represents a frequency, T represents a tension, L is a length of string, and ρ is a linear density of string.

According to the formula, it is appreciated that the frequency is proportional to the root value of tension, and so it is for the mask.

Further, in general, dissipation becomes great as frequency increases, whereas the dissipation decreases as frequency is lowered. That is, reduction of tension applied to the shadow mask results in the reduction of frequency, so that the dissipation would not easily occur as an amplitude becomes great with frequency reduced.

In other words, not only does miss-landing become great as the amplitude becomes great, but also the reduction does not take place rapidly. And, as a result, the phenomenon of vibration occurs continuously in the display.

Meanwhile, with reference to FIG. 9, an amount of frequency reduction measured after a thermal process is 5% at the center position of shadow mask, and 30% at the peripheral position conventionally, whereas an amount of frequency reduction measured after thermal process is 3% at the center position of shadow mask, and 18% at the peripheral position according to the present invention.

Therefore, the present invention achieves a result in which the amount of frequency reduction decreases about 2% at the center position of mask, and about 12% at a peripheral position after thermal process.

As a result, greater tension reduction is achieved because the amount of frequency reduction decreases greatly in the present invention compared to a conventional technique.

As described above, according to the present invention, tension decreasing phenomenon of shadow mask is reduced by preventing the deformation of main frame in the process of high thermal process by regulating the ratios of thickness, width, and height of the main frame to the thickness of shadow mask.

As a result, such problem is prevented as display quality is deteriorated by the occurrence of howling phenomena in the display due to the vibration of shadow mask incurred by the reduction of tension applied to the shadow mask.

What is claimed is:

1. A mask assembly for a color cathode ray tube comprises:

a panel, having a fluorescent surface disposed at an inner side thereof;

a funnel adhered to a rear side of said panel, wherein adhesion is enabled by frit glass;

a shadow mask coupled to the inner side of said panel, wherein a plurality of electron through-holes perform color discrimination for an electron beam; and a frame comprised of a main frame welded to the shadow mask at a front surface of said main frame for supporting said shadow mask toward the panel and a sub-frame supporting said main frame, wherein said sub-frame is joined to a rear surface of said main frame, wherein a relation of $T/t \geqq 45$ is satisfied, where t is the thickness of the shadow mask and T is the thickness of a part of the main frame where the main frame is welded to the shadow mask.

2. The mask assembly of claim 1, wherein a relation of $W/t \geqq 270$ is satisfied, where t is a thickness of the shadow mask and W is a width of a part of the main frame attached to the sub-frame.

3. The mask assembly of claim 1, wherein a relation of $H/t \geqq 270$ is satisfied, where t is a thickness of the shadow mask and H is a length of the main frame from said shadow mask to the sub-frame.

4. A mask assembly for a cathode ray tube comprising:

a panel having a fluorescent surface disposed at an inner side thereof;

a funnel adhered to a rear side of said panel wherein adhesion is enabled by frit glass;

a shadow mask coupled to the inner side of said panel, a front surface thereof facing the panel, wherein a plurality of electron through-holes perform color discrimination for an electron beam; and a frame composed of a main frame welded to a rear surface of the shadow mask for supporting said shadow mask to the panel, said main frame having a portion thereof attached to a sub-frame supporting said main frame, wherein a relation of $W/t \geqq 270$ is satisfied, where t is a thickness of the shadow mask and W is the width of the portion of the main frame attached to the sub-frame.

5. The mask assembly of claim 4, wherein a relation of $H/t \geqq 270$ is satisfied, where t is a thickness of the shadow mask and H is a length of the main frame from the shadow mask to the sub-frame.

6. A mask assembly for a cathode ray tube comprising:

a panel having a fluorescent surface disposed at an inner side thereof;

a funnel adhered to a rear side of said panel, wherein adhesion is enabled by frit glass;

a shadow mask coupled to the inner side of said panel, wherein a plurality of electron through-holes perform color discrimination for an electron beam; and a frame composed of a main frame welded to the shadow mask for supporting said shadow mask to the panel, and a sub-frame supporting said main frame, wherein relation of $H/t \geqq 270$ is satisfied, where t is a thickness of the shadow mask and H is a length of the main frame from said shadow mask to the sub-frame.

* * * * *